US006076021A

United States Patent [19]

Houriet, Jr. et al.

[11] Patent Number: 6,076,021

[45] Date of Patent: Jun. 13, 2000

[54] SYSTEM FOR HANDICAPPING SUBSTITUTE OR UNRANKED PLAYERS IN A DART GAME MATCH

[75] Inventors: John W. Houriet, Jr., Yardley; John C. Nydick, Havertown; Dean L. Hedin, Hatboro; Daniel L. Aymar, Bensalem; Thomas R. Horne, Bensalem; Robert H. Wiles, Bensalem, all of Pa.

[73] Assignee: Merit Industries, Inc., Bensalem, Pa.

[21] Appl. No.: 09/057,499

[22] Filed: Apr. 9, 1998

[51] Int. Cl.[7] ..... F41J 3/02

[52] U.S. Cl. ..... 700/93; 463/36; 273/371

[58] Field of Search ..... 463/7, 23, 29, 463/30, 40; 273/371, 148 R, 408, 409; 700/91–93

[56] References Cited

U.S. PATENT DOCUMENTS

| | | | |
|---|---|---|---|
| 3,907,290 | 9/1975 | Fischer et al. . | |
| 3,959,640 | 5/1976 | Syria . | |
| 4,057,251 | 11/1977 | Jones et al. . | |
| 4,131,948 | 12/1978 | Kaenel . | |
| 4,319,131 | 3/1982 | McGeary et al. . | |
| 4,367,526 | 1/1983 | McGeary et al. . | |
| 4,516,781 | 5/1985 | DeVale et al. . | |
| 4,592,546 | 6/1986 | Fascenda et al. . | |
| 4,716,529 | 12/1987 | Nakayama . | |
| 4,793,618 | 12/1988 | Tillery et al. . | |
| 4,881,744 | 11/1989 | Hansen . | |
| 4,974,857 | 12/1990 | Beall et al. . | |
| 5,083,271 | 1/1992 | Thacher et al. . | |
| 5,114,155 | 5/1992 | Tillery et al. | 273/371 |
| 5,116,063 | 5/1992 | Harlan et al. . | |
| 5,359,510 | 10/1994 | Sabaliauskas | 700/91 |
| 5,401,033 | 3/1995 | Lychock, Jr. . | |
| 5,553,861 | 9/1996 | Pan | 273/376 |
| 5,593,349 | 1/1997 | Miguel et al. | 463/30 |
| 5,743,533 | 4/1998 | Wiles et al. | 273/371 |
| 5,855,516 | 1/1999 | Eiba | 463/42 |
| 5,917,725 | 1/1999 | Thacher et al. | 700/91 |
| 5,971,397 | 10/1999 | Miguel et al. | 273/371 |

FOREIGN PATENT DOCUMENTS

| | | | |
|---|---|---|---|
| 2161629 | 1/1986 | United Kingdom | G06F 15/44 |
| 2192342 | 1/1988 | United Kingdom | A63F 9/22 |
| 9409337 | 4/1994 | WIPO . | |
| WO 98/31980 | 7/1998 | WIPO | F41J 5/04 |

OTHER PUBLICATIONS

Trademark NEUTRALIZER, American Darters Association, Inc. and explanation from internet, Jul. 23, 1996.

*Primary Examiner*—Jessica J. Harrison
*Assistant Examiner*—John M Hotaling
*Attorney, Agent, or Firm*—Akin, Gump, Strauss, Hauer & Feld, L.L.P

[57] ABSTRACT

A system is provided for handicapping unranked players in a dart game match, wherein the match includes a plurality of successively played games. Upon initiation of a match, a default average is assigned to an unranked player. An initial handicap is calculated for the unranked player based on the difference between the default average and an actual average of a ranked opponent of the unranked player. The initial handicap is then used for the first game in the match. At the end of the first game, a first new handicap is calculated for the unranked player based at least upon the unranked player's actual average in the first game. The first new handicap is used for the second game in the match. The unranked player's handicap is repeatedly recalculated after completion of each game in the match based at least upon the unranked player's actual average in previous games of the match. The recalculated handicaps are used for the next game in the match. After completion of all games in the match, a fixed handicap is established for the unranked player based at least upon the unranked player's actual average in all of the games of the completed match. The fixed handicap is used for subsequent matches. The player average may be points scored per dart or round, marks per dart or round, or any other suitable measure of performance. The handicap may be used to assign a spot dart, spot mark, or spot point handicap.

26 Claims, 2 Drawing Sheets

SYSTEM FOR HANDICAPPING SUBSTITUTE OR UNRANKED PLAYERS IN A DART GAME MATCH

BACKGROUND OF THE INVENTION

"Handicapping" describes the process of creating an environment where players of different abilities can engage in balanced competition. This is usually accomplished by making the competition more difficult for players with advanced skills or by making the competition easier for players with lesser abilities.

In dart competition, there are currently several methods of handicapping players, all of which are based upon player averages. The method depends upon the type of average used. Two types of averages are "points per dart" (hereafter, "PPD") and "marks per round" (hereafter, "MPR").

The PPD average is used in a variety of dart games, but primarily in '01 games, where a player begins with a first score (e.g., 301, 501, 701, 1001, etc.) and progresses downward to a second score (typically, zero) by hitting a dart board with darts. The game ends when a player reaches exactly the second score. In such games, a player normally throws three darts per turn. When a dart hits the board, a certain number of points are taken away from the player's score based upon which area of the target the dart lands. At the end of the game, the total number of points that a player has earned by hitting numbered areas is divided by the total number of darts that the player has thrown. The resulting number is the player's PPD average: Total Points Scored/Total Number of Darts Thrown.

The MPR average is typically used in Cricket games, where a player is required to hit certain targets on the dart board to score points. For example, the segments 15–20 may be the designated scoring targets for marks. The first player to hit all of the required marks and who also has the highest point total wins the game. In such games, a player throws three darts each turn or round. The MPR average is calculated in two steps. First, the number of rounds played is calculated by taking the total number of darts thrown by the player and dividing by three (the number of darts per round). Next, the number of required marks that a player hit during the game is divided by the number of rounds. The resulting number is the player's MPR average: Total Marks Hit/(Total Darts Thrown/3).

The PPD or MPR averages can be calculated based on an individual game, a match (i.e., a series of games), or a player's lifetime history.

In some handicapping systems, players are divided into groups based on their PPD average, MPR average, or estimated skill level. Each group or level is assigned a certain number, usually from zero to six, which becomes the assignment of a "spot dart" handicap. When a player is assigned a spot dart handicap, the opponent is permitted to throw that number of darts to earn points or marks before the handicapped player gets a chance to throw any darts. For example, a scheme for assigning spot darts when using the PPD average may work as follows:

PPD=1–20→Assign 0 spot darts

PPD=21–40→Assign 1 spot dart

PPD=41–60→Assign 2 spot darts In another spot dart scheme, the handicapped player must give the assigned number of darts to their opponent.

Other known handicapping schemes include "spot point" handicapping and "spot mark" handicapping. In these two methods, the handicapped player and the opposing player receive the same number of darts, but the goals that they need to achieve to win the game are different.

For example, when using spot point handicapping in the game of 301, the object of the game is for each player to take their score from 301 points to exactly zero points. If a player has a higher PPD average than his or her opponent, then the higher average player will need to earn the full 301 points to reach zero. However, when using the spot point handicapping feature, the opposing player will start the game with a lower score, such as 235, and thus only needs to earn 235 points to win the game. Alternatively, spot point handicapping may be used to "increase" the point total that the higher average player starts the game with (e.g., 350, instead of 301), while the lesser skilled player begins play at 301 points. Regardless of whether the better skilled player's score is increased or the lesser skilled player's score is decreased, the formula used to calculate spot points is selected so that if each player performs according to their average, both players would reach zero on the same dart throw number (e.g., on the 12th dart thrown, 14th dart thrown, etc.).

Spot mark handicapping is used primarily with Cricket games, where a player needs to hit marks on specific targets. The player with the higher MPR average is required to hit all of the specified marks to win the game, whereas the player with the lower MPR average starts the game with marks already scored, and therefor does not need to hit all of the specified marks to win.

Player handicapping is important to ensure that opposing players in dart leagues or tournaments are evenly matched. In dart leagues, careful records are kept of player scores, and player handicaps are continually updated with new score data to ensure that handicaps are accurate. However, it often occurs that one or more players on a team cannot be present for a particular match up against an opposing team, and that a substitute player fills in for the absent player. Other times, a team player drops out of the league, and the spot is filled by a new permanent league player. The new or substitute player may not have a known handicap, and is thus an "unranked player." The conventional approach to this problem is to assign a league default average to the unranked player. The league default average is standard across the entire league, and is used for all new or substitute players. For example, the league coordinator may set a default PPD average to be 25.0.

The conventional scheme for handling unranked players introduces significant unfairness into league play since the default handicap is theoretically selected to be only an average of all unranked players. Since unranked players actually fall along a distribution curve of averages, only a small percentage of unranked players will actually have a handicap close to the default handicap. Thus, one team or the other has an unfair advantage when an unranked player is used. If the unranked player is a new permanent league player, the unfairness is reduced for subsequent matches since the new player's handicap is calculated after the first match is over. However, the unfairness associated with substitute players occurs for every match which uses a substitute player.

Accordingly, there is a need for an improved handicapping scheme which minimizes unfairness associated with unranked players. The present invention fulfills such a need by providing a rolling or floating handicap average for unranked players.

BRIEF SUMMARY OF THE INVENTION

The present invention provides a system for handicapping unranked players in a dart game match, wherein the match includes a plurality of successively played games. Upon initiation of a match, a default average is assigned to an unranked player. An initial handicap is calculated for the unranked player based on the difference between the default average and an actual average of a ranked opponent of the unranked player. The initial handicap is then used for the first game in the match. At the end of the first game, a first new handicap is calculated for the unranked player based at least upon the unranked player's actual average in the first game. The first new handicap is used for the second game in the match. The unranked player's handicap is repeatedly recalculated after completion of each game in the match based at least upon the unranked player's actual average in previous games of the match. The recalculated handicaps are used for the next game in the match. After completion of all games in the match, a fixed handicap is established for the unranked player based at least upon the unranked player's actual average in all of the games of the completed match. The fixed handicap is used for subsequent matches.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred, it being understood, however, that the invention is not limited to the specific methods and instrumentalities disclosed. In the drawings.

DETAILED DESCRIPTION OF THE INVENTION

Figure 1:
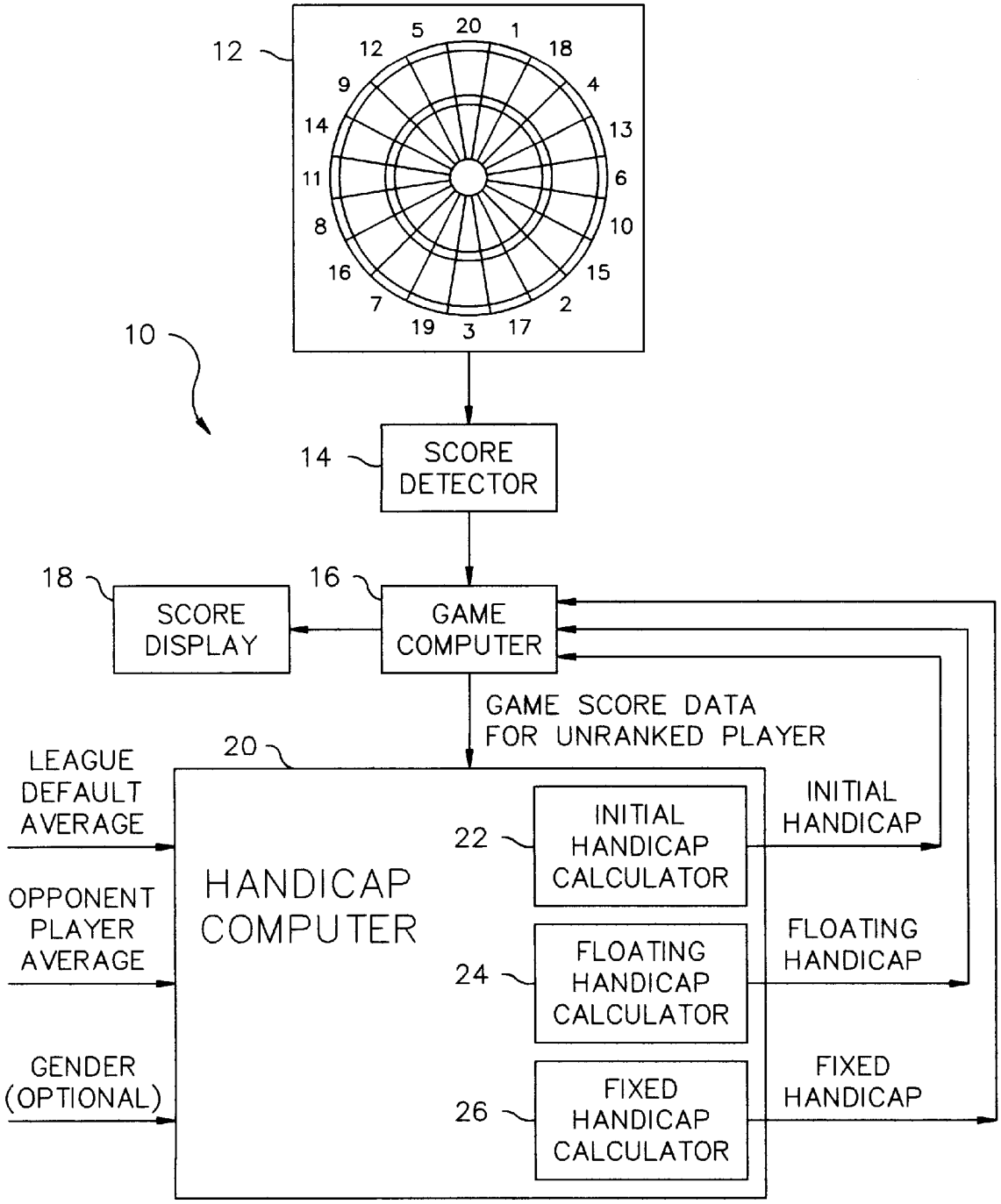
FIG. 1 is a schematic block diagram of an electronic dart game machine connected to a handicapping computer in accordance with a preferred embodiment of the present invention.
Figure 2:
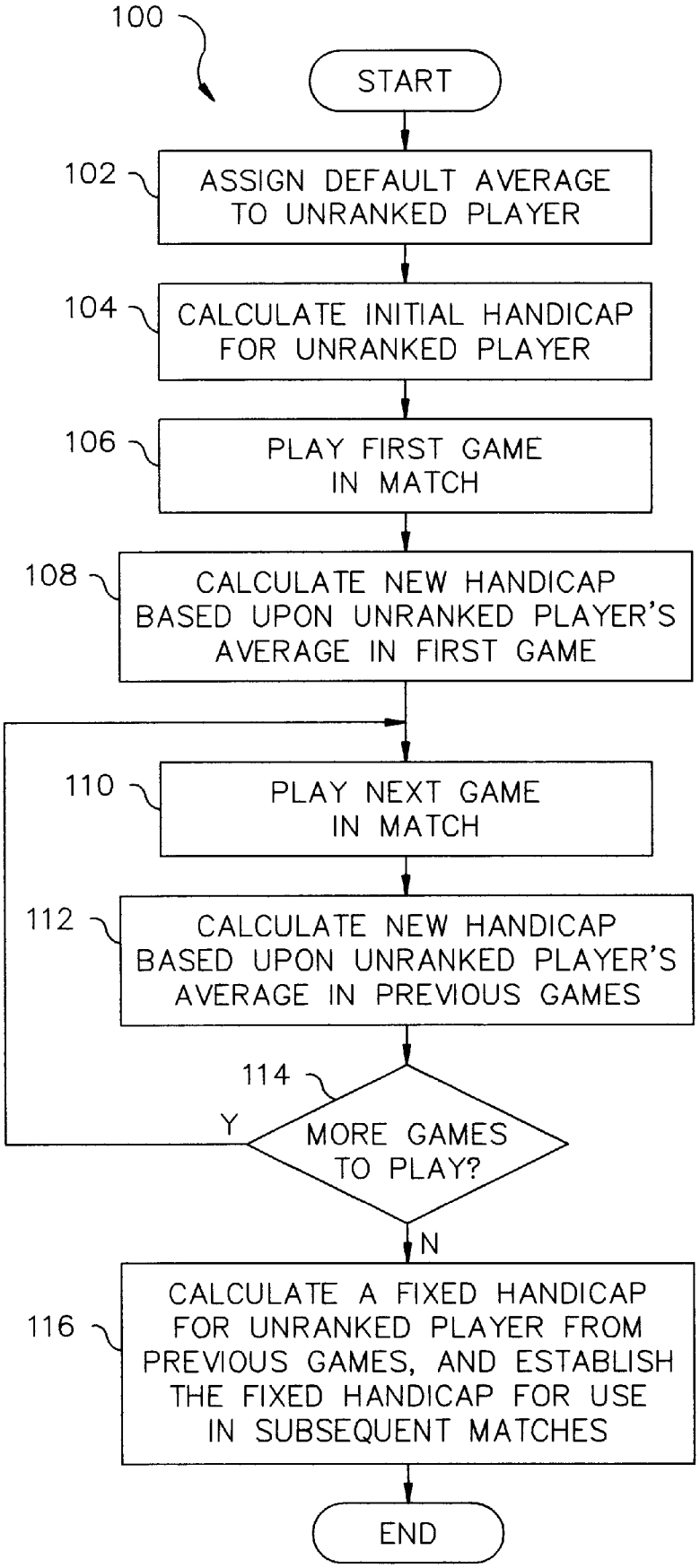
FIG. 2 is a flowchart of the operation of the handicap computer of FIG. 1.

Referring to the drawings wherein the same reference numerals are used to indicate the same components throughout the several figures, there is shown in FIGS. 1 and 2, a preferred embodiment of the present invention.

FIG. 1 shows a dart machine 10 including an electronic dart board 12, a score detector 14 connected at its input to the output of the electronic dart board 12, a game computer 16 connected at its input to the output of the score detector 14, a score display 18 connected at its input to the output of the game computer 16, and a handicap computer 20 having outputs connected to additional inputs of the game computer 16. The electronic dart board 12, score detector 14, and game computer 16 are well-known in the prior art. The score detector 14 may be any suitable means for identifying target areas of a dart board 12 which have been hit by a dart. The score detector 14 also identifies which segment of the dart board 12 has been hit so that the appropriate score may be tallied for a hit. Dart games which disclose electronic dart boards 12, score detectors 14 and game computers 16 are shown and described in U.S. Pat. No. 4,057,251 (Jones et al.); U.S. Pat. No. 4,516,781 (DeVale et al.); U.S. Pat. No. 4,793,618 (Tillery et al.); U.S. Pat. No. 4,881,744 (Hansen); U.S. Pat. No. 4,974,857 (Beall et al.); U.S. Pat. No. 5,116,063 (Harlan et al.); and U.S. Pat. No. 5,401,033 (Lychock, Jr.), the subject matter of which are incorporated herein by reference.

The handicap computer 20 incorporate the novel features of the present invention, and includes an initial handicap calculator 22, a floating handicap calculator 24 and a fixed handicap calculator 26. In a conventional dart machine 10 used for dart league play, the game computer 16 has an input for receiving player handicap data for enrolled league players (not shown) and a league default average which is used to calculate the handicap for any unranked players participating in the current match. In the present invention, the handicap computer 20 has inputs for receiving an opponent player average and the league default average, and outputs for sending the appropriate handicap data to the game computer 16. The outputs represent the handicap assigned to the new or unranked player. There are three different outputs from the handicap computer 20, as follows: INITIAL HANDICAP: This handicap is used in the first game of a match and is calculated using the league default average and the enrolled, ranked opponent player average. FLOATING HANDICAP: This handicap is used in subsequent games of the match and may change after each game. FIXED HANDICAP: This handicap is established after completion of the first match played by the unranked player, and is used in subsequent matches.

The handicap computer 20 executes a program having the steps set forth in flowchart 100 of FIG. 2. The program of FIG. 2 is executed for each pair of matched players. Referring to FIG. 2, the unranked player is assigned a default average (step 102). Typically, the default average is a league default average which is standard across the entire league and which is used for all new or substitute (unranked) players. Next, an initial handicap is determined for the unranked player.

Consider the following example to illustrate steps 102 and 104 when two players initiate a match. One player, who has been previously enrolled in the league, has an established PPD average of 20.0, and the other player is unranked. The league coordinator has set a default PPD average for unranked players to be 25.0. For the first game, the unranked player is assigned a PPD average of 25.0. The two players are thus handicapped based upon the difference between their PPD averages. The handicapping process is conventional and thus is not described in further detail herein. The handicapping process may be used to compute a spot dart handicap, a spot mark handicap, or a spot point handicap, or any other suitable handicap. The particular type of handicap depends upon the type of dart game being played, as described above. When using the Scorpion DX electronic dart board, manufactured by Merit Industries, it is preferred to use either a spot point or spot mark handicap.

After the initial handicap is calculated for the unranked player, the first game in the match is played (step 106). Next, a new handicap is calculated based upon the unranked player's PPD or MPR average in the first game (step 108). This new average becomes the floating handicap of FIG. 1. The particular type of average used depends upon the scheme selected by the league. Preferably, the new handicap is calculated based solely upon the unranked player's actual average in the first game. However, other schemes are within the scope of the invention, such as using the average of the default value and the first game average, or using a weighted combination of the two.

The next game in the match is played (step 110) using the new handicap. After completion of the next game, a new floating handicap is calculated based upon the unranked player's average in the first and second games (step 112). Preferably, the new handicap is calculated based solely upon the unranked player's actual average in the first and second games. However, other schemes are within the scope of the invention, such as using weighted combinations of the first and second game averages, or the first, second and default average.

If there are more games in the match ("YES" output from step 114), then the next game is played (step 110) using the new handicap and another new, floating handicap is calculated based upon the first, second and third game averages (step 112). Steps 110 and 112 are repeated until all of the games in the match are completed ("NO" output from step 114).

After all of the games in the match are completed, a fixed handicap is calculated for the unranked player using the averages from all previous games (step 116). Again, the fixed handicap is preferably calculated based solely upon the unranked player's actual average in each of the games played. However, other schemes are within the scope of the invention, such as using weighted combinations of the actual game averages, or weighted combinations of the actual game averages and the default average. The fixed handicap is used for subsequent matches played by the unranked player. If the unranked player is a new player who has just enrolled in the league, as opposed to a substitute player, the player average for all completed games of the match and any subsequent matches for the day are used to set the new player's league average in the same manner as averages are adjusted for previously enrolled players.

To further minimize any potential unfairness at the initiation of game play, the league default average can be made gender specific. The particular averages would be selected based upon experience data from male and female players. A male player would thus be assigned a different initial handicap than a female player.

An alternative embodiment of the invention would involve calculating the floating handicap after each dart throw, rather than after each game. This would allow the unranked player's handicap to more quickly move toward the player's actual handicap. This refinement would require additional programming steps since modifying the handicap during game play would affect the winner determination process or would dynamically affect the number of darts which are allowed to be thrown by the respective players.

The present invention may also be used with a modification of the spot dart handicap scheme. In this scheme, the better player would have the number of darts that he or she can throw taken away automatically by the electronic dart board. The number of darts taken away would depend upon the skill level of the better player relative to the weaker player. The number of darts taken away would change for each game based on the floating average of the unranked player.

The present invention may also be used with other types of handicapping schemes, including player averages based upon "points per round" and "marks per dart." The present invention may be used in other types of games which use handicaps, and the scope of the invention includes the use of the rolling or floating handicap scheme in other gaming environments where unranked players participate in a league or tournament.

The present invention provides a process to more accurately assess a new player and subsequently handicap all players more fairly. It will be appreciated by those skilled in the art that changes or modifications could be made to the above-described embodiments without departing from the broad inventive concepts of the invention. It should be appreciated, therefore, that the present invention is not limited to the particular embodiments disclosed but is intended to cover all embodiments within the scope or spirit of the appended claims.

We claim:

1. A method for handicapping unranked players in a dart game match, the match including a plurality of successively played games, the method comprising the steps of:

(a) assigning a default average to an unranked player upon initiation of the match;

(b) calculating an initial handicap for the unranked player based on the difference between the default average and an actual average of a ranked opponent of the unranked player, the initial handicap being used for the first game in the match;

(c) calculating a first new handicap for the unranked player at the end of the first game, the first new handicap being based at least upon the unranked player's actual average in the first game, the first new handicap being used for the second game in the match; and (d) repeatedly recalculating the unranked player's handicap after completion of each game in the match based at least upon the unranked player's actual average in previous games of the match and using the recalculated handicaps for the next game in the match.

2. A method according to claim 1 wherein in step (c), the first new handicap is calculated based solely upon the unranked player's actual average in the first game.

3. A method according to claim 2 wherein in step (d), the recalculated handicap is determined solely by using the unranked player's actual average in previous games of the match.

4. A method according to claim 1 wherein in step (d), the recalculated handicap is determined solely by using the unranked player's actual average in previous games of the match.

5. A method according to claim 1 further comprising the step of:

(e) establishing a fixed handicap for the unranked player upon completion of the match based at least upon the unranked player's actual average in all of the games of the completed match, the fixed handicap being used for subsequent matches.

6. A method according to claim 1 wherein the default average and actual averages are based upon points scored per dart or points scored per round.

7. A method according to claim 1 wherein the default average and actual averages are based upon marks per dart or marks per round.

8. A method according to claim 1 wherein step (a) includes assigning the default average based upon the gender of the unranked player.

9. A method according to claim 1 wherein steps (b), (c) and (d) each include using the handicaps to adjust the score of the unranked player relative to the ranked opponent.

10. A method according to claim 1 wherein steps (b), (c) and (d) each include using the handicaps to assign a spot dart handicap.

11. A method according to claim 1 wherein steps (b), (c) and (d) each include using the handicaps to assign a spot mark handicap.

12. A method according to claim 1 wherein steps (b), (c) and (d) each include using the handicaps to assign a spot point handicap.

13. A method according to claim 1 wherein the players in the dart game all begin with a first score and progress to a second score by hitting a dart board with darts, the game ending when a player reaches exactly the second score, and steps (b), (c) and (d) each include using the handicaps to assign a respective second score for the unranked player and ranked opponent.

14. A handicap computer for handicapping unranked players in a dart game match, the match including a plurality of successively played games, the handicap computer comprising:

(a) an initial handicap calculator for calculating an initial handicap for the unranked player based on the difference between a default average assigned to the unranked player and an actual average of a ranked opponent of the unranked player, the initial handicap being used for the first game in the match; and (b) a floating handicap calculator for (i) calculating a first new handicap for the unranked player at the end of the first game, the first new handicap being based at least upon the unranked player's actual average in the first game, the first new handicap being used for the second game in the match, and (ii) repeatedly recalculating the unranked player's handicap after completion of each game in the match based at least upon the unranked player's actual average in previous games of the match, the recalculated handicaps being used for the next game in the match.

15. A handicap computer according to claim 14 wherein the floating handicap calculator calculates the first new handicap based solely upon the unranked player's actual average in the first game.

16. A handicap computer according to claim 15 wherein the floating handicap calculator determines the recalculated handicap solely by using the unranked player's actual average in previous games of the match.

17. A handicap computer according to claim 14 wherein the floating handicap calculator determines the recalculated handicap solely by using the unranked player's actual average in previous games of the match.

18. A handicap computer according to claim 14 further comprising:

(c) a fixed handicap calculator for establishing a fixed handicap for the unranked player upon completion of the match based at least upon the unranked player's actual average in all of the games of the completed match, the fixed handicap being used for subsequent matches.

19. A handicap computer according to claim 14 wherein the default average and actual averages are based upon points scored per dart or points scored per round.

20. A handicap computer according to claim 14 wherein the default average and actual averages are based upon marks per dart or marks per round.

21. A handicap computer according to claim 14 wherein the initial handicap calculator assigns the default average based upon the gender of the unranked player.

22. An handicap computer according to claim 14 wherein the initial handicap calculator and the floating handicap calculator use the handicaps to adjust the score of the unranked player relative to the ranked opponent.

23. A handicap computer according to claim 14 wherein the initial handicap calculator and the floating handicap calculator use the handicaps to assign a spot dart handicap.

24. An handicap computer according to claim 14 wherein the initial handicap calculator and the floating handicap calculator use the handicaps to assign a spot mark handicap.

25. An handicap computer according to claim 14 wherein the initial handicap calculator and the floating handicap calculator use the handicaps to assign a spot point handicap.

26. An handicap computer according to claim 14 wherein the players in the dart game all begin with a first score and progress to a second score by hitting a dart board with darts, the game ending when a player reaches exactly the second score, and the initial handicap calculator and the floating handicap calculator use the handicaps to assign a respective second score for the unranked player and ranked opponent.

* * * * *